US006409553B1

(12) United States Patent
Krause et al.

(10) Patent No.: US 6,409,553 B1
(45) Date of Patent: Jun. 25, 2002

(54) BATTERY CLAMP

(75) Inventors: Jens Krause, Rahden; Thomas Heimann, Espelkamp, both of (DE)

(73) Assignee: Harting Automotive GmbH & Co., KG (DE)

( * ) Notice: Subject to any disclaimer, the term of this patent is extended or adjusted under 35 U.S.C. 154(b) by 0 days.

(21) Appl. No.: 09/663,279

(22) Filed: Sep. 15, 2000

(30) Foreign Application Priority Data

Sep. 22, 1999 (DE) ..... 199 45 407

(51) Int. Cl.[7] ..... H01R 4/38

(52) U.S. Cl. ..... 439/757; 439/759; 439/761; 439/773

(58) Field of Search ..... 439/726, 754–57, 439/759–761, 770–74

(56) References Cited

U.S. PATENT DOCUMENTS

| | | | | | |
|---|---|---|---|---|---|
| 1,596,891 | A | | 8/1926 | Rensch | |
| 2,043,557 | A | | 6/1936 | Pulici | |
| 2,445,946 | A | * | 7/1948 | Harper | 439/759 |
| 2,769,964 | A | | 11/1956 | Lartz | |
| 3,116,100 | A | | 12/1963 | Hunter | |
| 3,568,139 | A | * | 3/1971 | Delzer | 439/759 |
| 5,586,919 | A | * | 12/1996 | Ritson | 439/757 |
| 5,707,257 | A | * | 1/1998 | Kotajima et al. | 439/761 |

FOREIGN PATENT DOCUMENTS

| | | | | |
|---|---|---|---|---|
| CA | 0458151 | * | 7/1949 | 439/761 |
| CA | 0605717 | * | 9/1960 | 439/773 |
| DE | 36 43 087 A1 | | 6/1987 | |
| DE | 94 05 680 U1 | | 8/1994 | |
| DE | 44 26 591 A1 | | 2/1995 | |

* cited by examiner

*Primary Examiner*—P. Austin Bradley
*Assistant Examiner*—Larisa Tsukerman
(74) *Attorney, Agent, or Firm*—Cook, Alex, McFarron, Manzo, Cummings & Mehler, Ltd.

(57) ABSTRACT

A battery clamp comprises a connecting lug (12), a contact ring (10) which is provided with a slot so as to form two opposite clamping ends (14). Each clamping end includes a bent lug (16), and a slope (18). A spring (22) engages the clamping ends of the contact ring. A blocking wedge (28) is positioned between the bent lugs of the clamping ends and can be shifted between a mounting position in which it keeps the clamping ends of the contact ring in a spread condition, and a contact position in which it releases the clamping ends so that the spring can pull the clamping ends together.

7 Claims, 5 Drawing Sheets

BATTERY CLAMP

BACKGROUND OF THE INVENTION

The invention relates to a battery clamp which contacts a generally conical battery contact consisting of lead.

When such a battery contact is contacted, there is a problem providing a defined contact force as precisely as possible for reliable contacting. In the case that the contact forces are too small, only insufficient metallic contact results between the battery contact and the battery clamp. However, if the contact forces are excessively great, this will lead to a deformation and the flowing of the battery contact material.

The most common battery clamp consists of a contact clip which is placed onto the battery contact and is then pulled together by means of a screw. The drawback of this kind of battery clamp is that the actually applied contact force can be controlled only insufficiently. On the one hand, there is the danger that by tightening the screw with a wrench a much greater tightening torque, and thus a much greater contact force, is applied than actually required. On the other hand, if the battery clamp is used for an already deformed battery contact a situation may occur where a high tightening moment for the screw is obtained, which, however, does not correspond with the actually obtained smaller contact force.

The prior art also discloses various battery clamps which use spring elements which are to ensure a constant contact force. However, these battery clamps have a comparatively complex design.

BRIEF SUMMARY OF THE INVENTION

The object of the invention consists in providing a battery clamp which can be produced simply and in a cost-effective manner with fail-safe handling and can be mounted both manually and in automated fashion with a high degree of reliability while avoiding the occurrence of incorrect mounting.

This object is achieved according to the invention by a battery clamp having a connecting lug, and a contact ring which is provided with a slot so as to form two opposite clamping ends. Each clamping end includes a bent lug, and a slope. A spring engages the clamping ends of the contact ring. A blocking wedge is positioned between the bent lugs of the clamping ends and can be shifted between a mounting position in which it keeps the clamping ends of the contact ring in a spread condition, and a contact position in which it releases the clamping ends so that the spring can pull the clamping ends together. Thus, two defined states of the battery clamp are possible, namely, the mounting position, in which the battery clamp can be slipped freely onto the conical battery contact until the contact ring abuts in planar fashion against the battery contact, and the contact position, in which the contact ring is resiliently pulled together around the battery contact. The contact force applied in this case is determined by the spring design and this connection remains constant even over a prolonged period of time because of the resilient bias applied by the spring. Furthermore, the translational motion of the blocking wedge, which can be achieved simply, suffices to spread the contact ring from its contact position into its mounting position.

According to the preferred embodiment of the invention, each bent lug is provided with an arresting edge. The blocking wedge is supported on this arresting edge when the battery clamp is in its mounting position, in which the clamping ends of the contact ring are held in a spread condition. In this way, a comparatively great actuation force is required to move the blocking wedge beyond the arresting edge to reach the clamping position. This ensures that unintended transfer of the battery clamp from the mounting position to the contact position is prevented. The great actuation force to be applied also results in an advantageous kind of battery clamp mounting. If the arresting edge is designed to be sharp-edged, as is preferred, the blocking wedge cannot be moved beyond the arresting edge by a mere force of pressure. This will only be possible if the clamping ends were slightly spread beforehand. This can be achieved by forcing the battery clamp, being in the mounting position, onto the conical battery contact. The contact ring is spread slightly by the conical battery contact when the battery clamp is forced onto the battery contact by the application of a defined force, so that planar contact results. Then, the blocking wedge can slip over the arresting edge and release the clamping ends of the contact ring, so that the spring can pull the clamping ends together. The final contact force is thus determined exclusively by the spring design, however the initial contact force, i.e. when the battery clamp is forced onto the battery contact, ensures that planar contact occurs between the battery contact and the contact ring. This results in a high mounting reliability, since the transfer of the blocking wedge from its mounting position to its contact position will not be possible until the initial contact force is applied between the contact ring and the battery contact to cause a corresponding spreading of the contact ring. This initial contact force ensures a reliable fit of the battery clamp and avoids regions of a point contact between the conical battery contact and the battery clamp.

According to the preferred embodiment of the invention, it is provided that the blocking wedge is connected with a pivotally mounted covering cap. The covering cap serves both as a protection for the battery clamp and a mounting aid. The covering cap offers a suitable pressure plane in order to apply the required putting-on force by hand. The force of pressure exerted on the covering cap simultaneously serves for transferring the blocking wedge from the mounting position to the contact position. Since the putting-on of the battery clamp and the subsequent locking by transferring the blocking wedge from the mounting position to the contact position is effected in a single direction, mounting can be automated easily. Manual mounting does not make any problems either, since it only consists of forcing the battery clamp onto the battery contact. In both cases, the jolt which occurs as a result of the blocking wedge overcoming the arresting edge represents a well-noticeable indication of the fact that the mounting has been concluded successfully in both automated and manual mounting.

The covering cap is preferably provided with a lever by means of which the blocking wedge can be moved upwards via the covering cap into the mounting position. For this purpose, the lever having a suitable support must only be lifted upwards and away from the battery contact, whereby both the transfer of the contact ring from the contact position to the mounting position and the lifting of the battery clamp from the battery contact is obtained by means of a motion in a single direction.

According to a preferred embodiment of the invention the inner side of the contact ring is provided with a knurling 15. This ensures a reliable fit of the contact ring on the conical battery contact so that the contact ring cannot "float away" upwardly.

Advantageous embodiments of the invention read from the claims.

BRIEF DESCRIPTION OF THE DRAWINGS

The invention is described below with reference to a preferred embodiment which is shown in the appending drawings, in which.

DETAILED DESCRIPTION OF THE INVENTION

Figure 1:
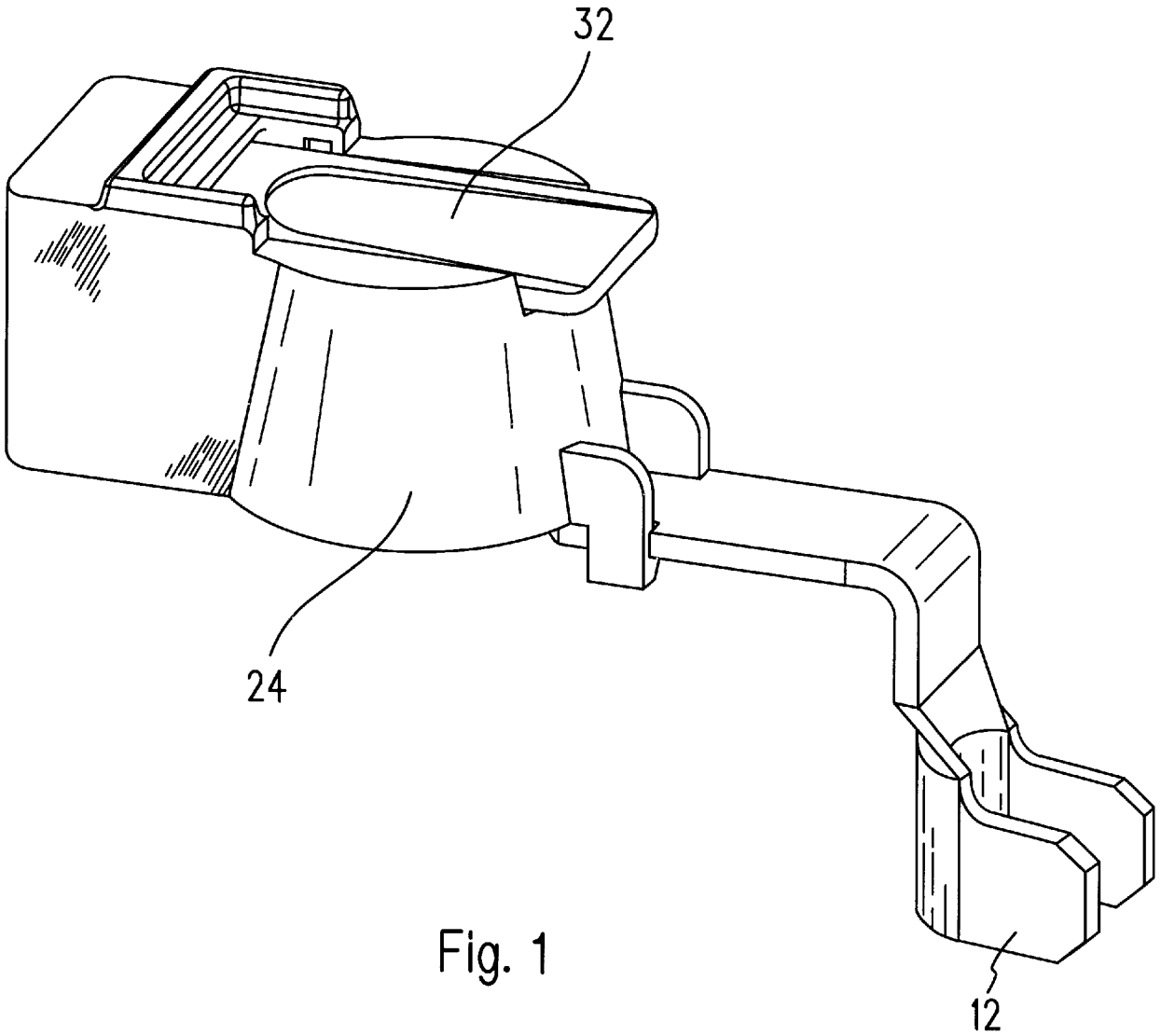
FIG. 1 shows a battery clamp according to the invention in a perspective view.
Figure 2:
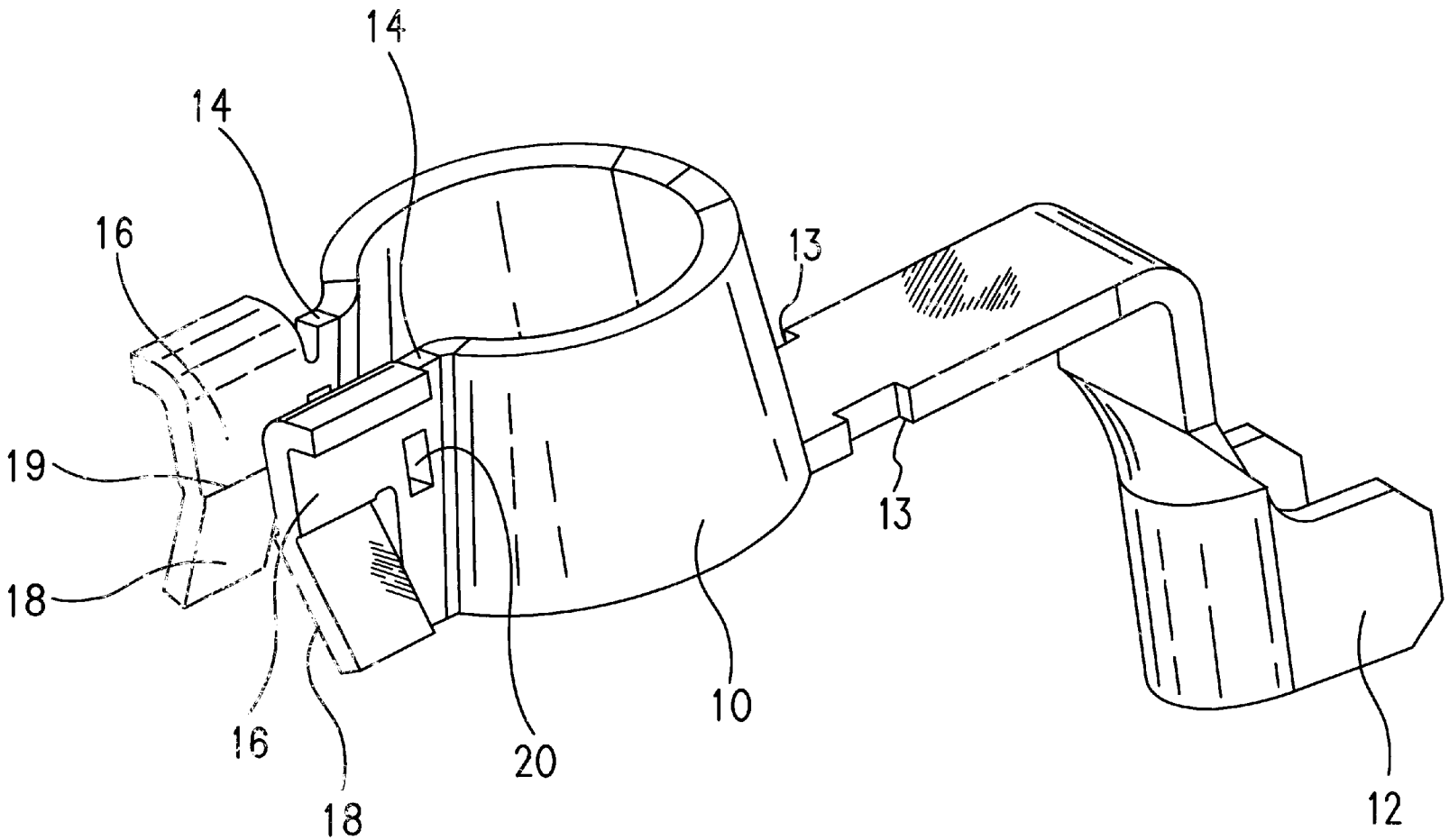
FIG. 2 shows the contact ring with the connecting lug, which is used in the battery clamp of FIG. 1, in a perspective view.

The battery clamp according to the invention has a contact ring 10 as a central component, which is provided with a connecting lug 12. The connecting lug serves for contacting any conductor which is to be connected to a battery contact. The contact ring 10 is designed with a slot to form two opposite clamping ends 14 each provided with a bent lug 16. Each bent lug 16 is provided with a slope 18 and a recess 20. An arresting edge 19 is formed at the transition between the slope 18 and the bent lug 16 and protrudes by about 0.3 to 0.5 mm.

The component consisting of the contact ring 10 with the bent lugs 16 and the connecting lug 12 is a one-piece bent sheet metal part having a wall thickness of about 1.5 to 1.8 mm. Here, the contact ring 10 is bent so as to adapt it to the conical shape of the battery contact to be connected.

Figure 3:
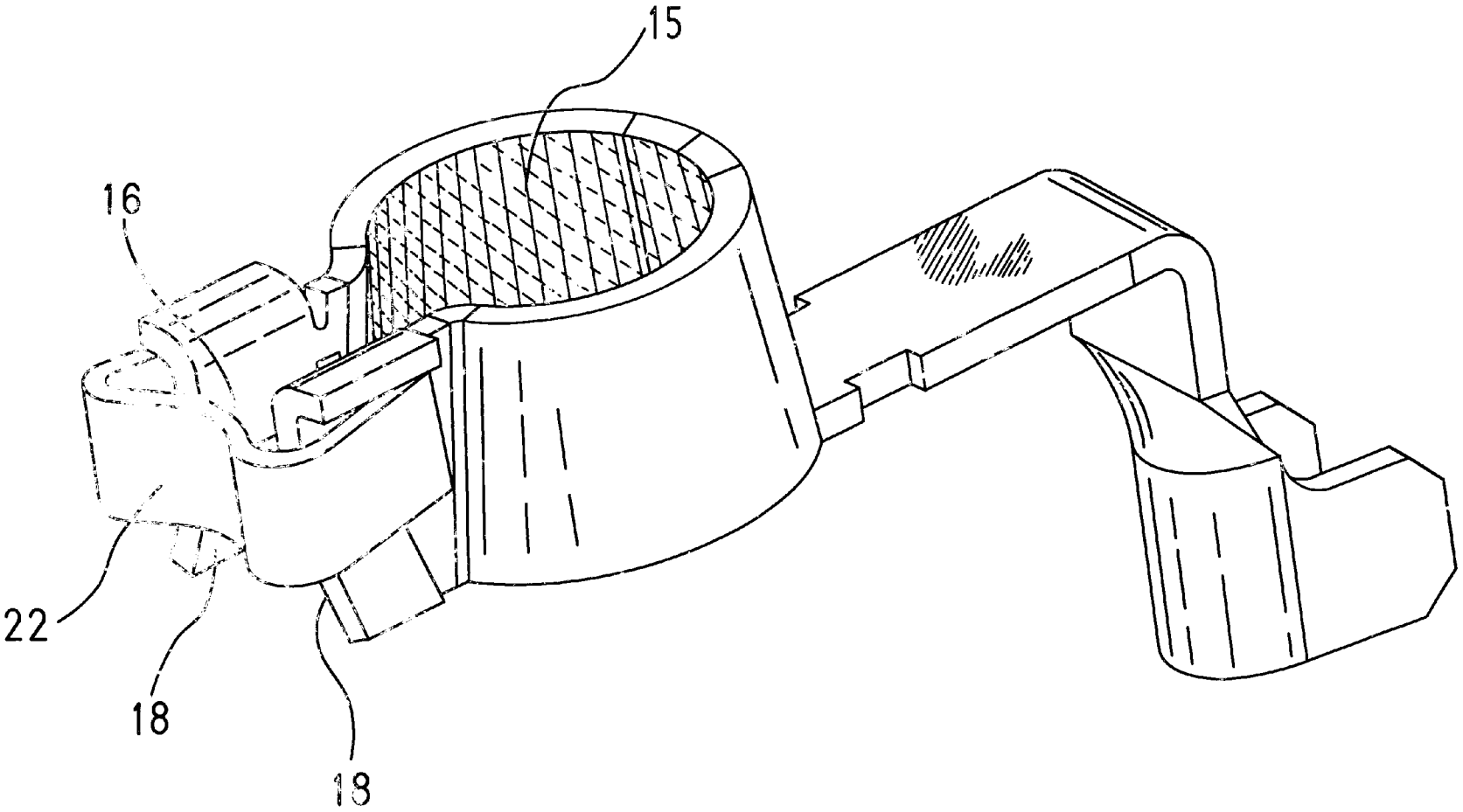
FIG. 3 shows the contact ring with the connecting lug of FIG. 2 including a spring.

A spring 22 (see FIG. 3) engages the lugs 16 of the contact ring 10, which spring tries to press the lugs 16 together. In order to prevent the spring 22 from slipping off, it is provided with two projections which engage the recesses 20 of the bent lugs 16.

The battery clamp is provided with a covering cap 24 (see in particular FIG. 5) which covers the contact ring 10 and is pivotally supported in notches 13 of the connecting lug 12. The covering cap 24 is provided with a blocking wedge 28 which is integrally formed on the covering cap 24 by a material ridge 30 and is positioned between the two bent lugs 16 of the contact ring 10, which are provided with the slopes 18.

A lever 32 is supported on the covering cap 24 by means of bearing pins 34. One end extends from the bearing pin 34 beyond the contact ring 10, and the other end of the lever 32 is supported on two supporting surfaces 36 which are formed on the bent lugs 16. In the area of the two supporting surfaces 36, the other end of the lever is forked, so that the material ridge 30 can extend between the two-forked end of the lever.

Figure 4:
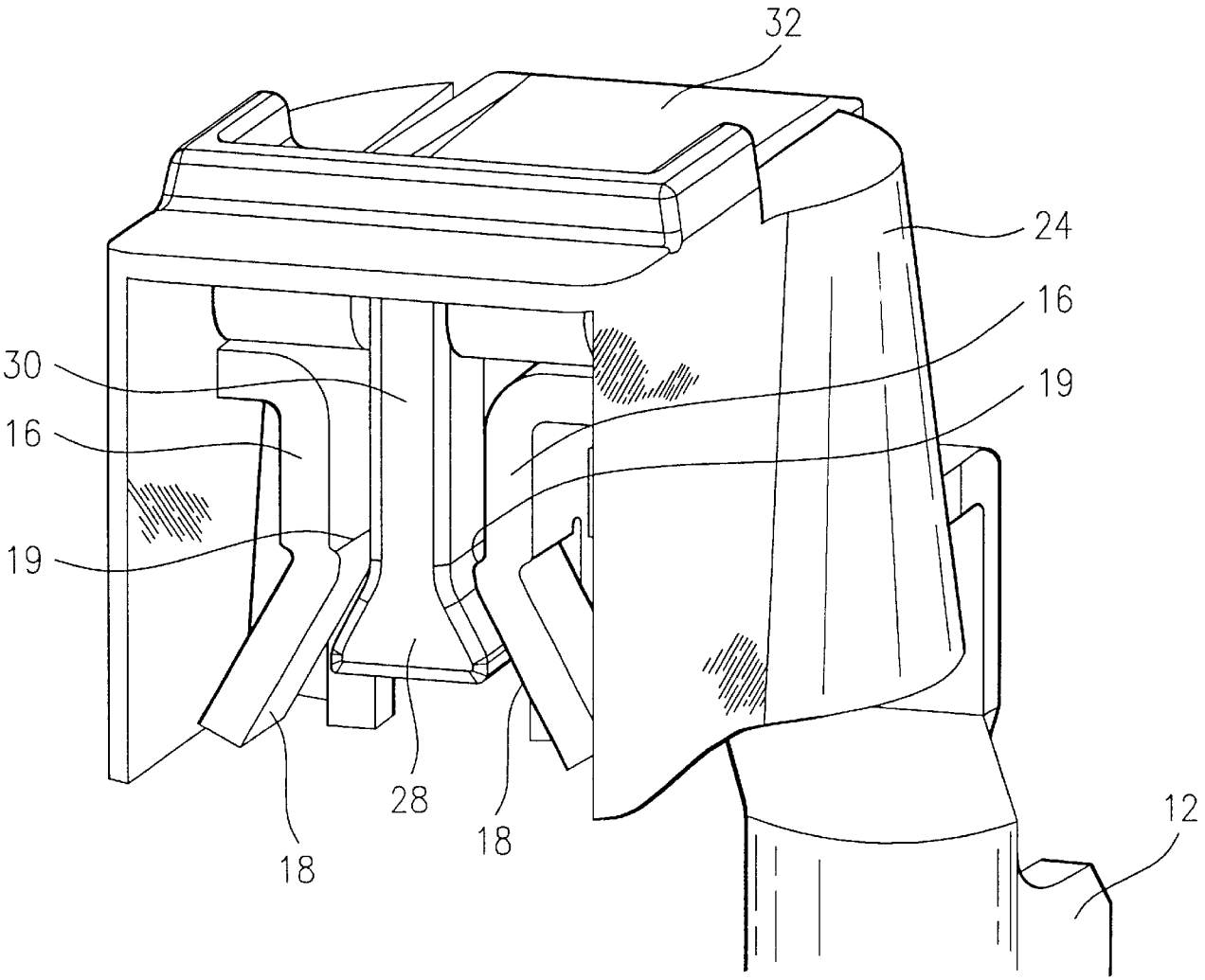
FIG. 4 shows a detail of the battery clamp of FIG. 1 in a perspective view.
Figure 5:
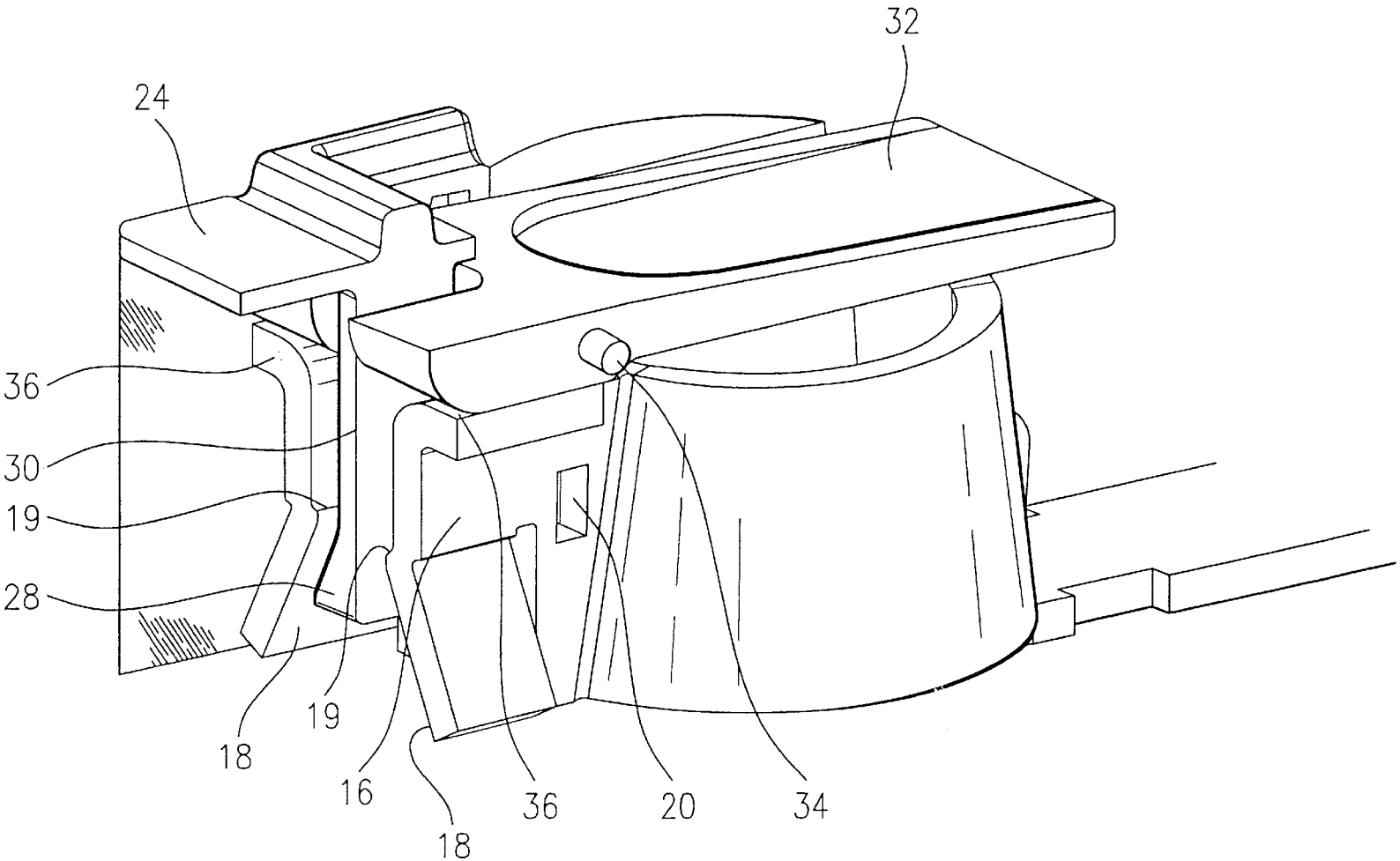
FIG. 5 shows another detail of the battery clamp of FIG. 1 in a perspective, partially cut view.

The blocking wedge 28 together with the covering cap 24 can be shifted between a contact position which is shown in FIGS. 1, 4 and 5 and a mounting position which is not shown in the Figures. In the contact position, the blocking wedge is disposed in an area between the two slopes 18, where it does not touch them. Thus, the two bent lugs 16 can be pulled together by the spring 22. In the mounting position, the blocking wedge 28 is disposed between the two bent lugs 16 and positioned upwardly from the two slopes 18, such that the blocking wedge abuts against the arresting edge 19, which prevents the blocking wedge from reaching the contact position unintentionally.

The battery clamp according to the invention is mounted in the following way: When delivered, the battery clamp is in its mounting position in which the blocking wedge 28 spreads the two bent lugs 16 whereby the contact ring 10 is spread as well. In this state, the battery clamp can be placed either manually or by an assembly robot on the conical battery contact to be connected. This is done by exerting a force of pressure onto the covering cap 24. In this connection, the force exerted onto the covering cap 24 is transmitted to the contact ring 10 via the notches 13, on the one hand, and the material ridge 30 and the blocking wedge 28 abutting against the arresting edges 19, on the other. Because of the conical design of the battery contact and the contact ring abutting against it, the exerted force of pressure is converted into a spreading force acting on the contact ring 10 when the contact ring is moved onto the battery contact to a corresponding extent. This spreading force slightly widens the contact ring and enables the blocking wedge 28 to slip downwardly over the arresting edge 19 under the influence of the still exerted force of pressure when the bent lugs 16 are moving apart. The covering cap 24 is then further moved onto the contact ring 10, the blocking wedge 28 being transferred into its contact position in which it no longer engages the bent lugs 16 and the slopes 18. Then, the bent lugs 16 are pressed together by the spring 22, so that the contact ring is pulled together and a uniform contact force results.

The covering cap is released by lifting the lever 32 at its external free end. This causes the covering cap to be lifted off the contact ring 10 via the bearing pins 34, whereby the blocking wedge 28 is pulled through between the two slopes 18 and beyond the arresting edge 19. In this state, the contact ring 10 is spread again, so that the battery clamp can be removed from the battery contact by further pulling the lever 32.

A special advantage of the battery clamp according to the invention consists in carrying out the mounting and dismounting in only one moving direction. For the purpose of mounting only a force of pressure has to be exerted on the covering cap 24 of the battery clamp. This force of pressure initially ensures that the contact ring is firmly forced onto the battery contact to be connected. Here, a planar contact already results between the battery contact and the contact ring. Transfer of the battery clamp from the mounting position to the contact position will only be possible if the contact force obtained here exceeds a defined value which can be adjusted by the height of the arresting edges 19. Having released the blocking wedge 28, this is performed by the same force of pressure which then moves the blocking wedge into a region in which the wedge no longer engages the lugs and the slopes. This mounting method also brings about a high degree of fail-safe handling. The slipping of the blocking wedge 28 over the arresting edges 19 can be detected reliably in the case of both manual and automated mounting and supplies an indication of the fact that the battery clamp is reliably locked on the battery contact.

The battery clamp is also dismounted along a single actuation direction. Only a pulling force must be exerted on the lever 32 in a direction leading away from the battery contact. This pulling force initially transfers the battery clamp from the contact position to the mounting position and then pulls the battery clamp off the battery contact.

What is claimed is:

1. A battery clamp comprising a connecting lug (12), a contact ring (10) which is provided with a slot so as to form two opposite clamping ends (14), each clamping end provided with a bent lug (16), a slope (18) and an arresting edge (19), a spring (22) which engages the clamping ends of the contact rings, a blocking wedge (28) which is positioned between the bent lugs (16) of the clamping ends and can be shifted between a mounting position, in which the blocking wedge keeps the clamping ends of the contact ring in a spread condition, and a contact position, in which the blocking wedge releases the clamping ends so that the spring can pull the clamping ends together, and a pivotally mounted covering cap (24), the blocking wedge (28) being connected with the pivotally mounted covering cap (24).

2. The battery clamp according to claim 1, characterized in that a lever (32) is supported on the covering cap (24), by means of which the blocking wedge can be moved via the covering cap into the mounting position.

3. The battery clamp according to claim 2, characterized in that the inner side of the contact ring is provided with a knurling (15).

4. A battery clamp comprising a connecting lug (12), a contact ring (10) which is provided with a slot so as to form two opposite clamping ends (14), each clamping end including a bent lug (16), a slope (18) and an arresting edge (19), a spring (22) which engages the clamping ends of the contact rings such that the bent lugs (16) of the contact ring are pressed inwardly, and a blocking wedge (28) which is positioned between the bent lugs of the clamping ends and can be shifted between a mounting position, in which the blocking wedge is positioned upwardly from the arresting edge such that the clamping ends of the contact ring are kept in a spread condition, and a contact position, in which the blocking wedge is positioned downwardly from the arresting edge and in spaced relation to the clamping end such that the blocking wedge releases the clamping ends and the spring can pull the clamping ends together.

5. The battery clamp according to claim 4 in that the blocking wedge (28) is connected with a pivotally mounted covering cap (24).

6. The battery clamp according to claim 5, characterized in that a lever (32) is supported on the covering cap (24), by means of which the blocking wedge can be moved via the covering cap into the mounting position.

7. The battery clamp according to claim 6, characterized in that the inner side of the contact ring is provided with a knurling (15).

* * * * *